US011697966B2

(12) United States Patent
Adkins et al.

(10) Patent No.: US 11,697,966 B2
(45) Date of Patent: Jul. 11, 2023

(54) UNDERGROUND HORIZONTAL DIRECTIONAL DRILL

(71) Applicant: THE TORO COMPANY, Bloomington, MN (US)

(72) Inventors: Casey Lee Adkins, Apple Valley, MN (US); Benjamin Allan Street, Northfield, MN (US)

(73) Assignee: THE TORO COMPANY, Bloomington, MN (US)

( * ) Notice: Subject to any disclaimer, the term of this patent is extended or adjusted under 35 U.S.C. 154(b) by 511 days.

(21) Appl. No.: 16/710,497

(22) Filed: Dec. 11, 2019

(65) Prior Publication Data

US 2020/0199940 A1 Jun. 25, 2020

Related U.S. Application Data

(60) Provisional application No. 62/783,382, filed on Dec. 21, 2018.

(51) Int. Cl.
*E21B 7/02* (2006.01)
*E21B 3/02* (2006.01)
*E21B 7/04* (2006.01)

(52) U.S. Cl.
CPC ..... *E21B 7/024* (2013.01); *E21B 3/02* (2013.01); *E21B 7/046* (2013.01)

(58) Field of Classification Search
CPC . E21B 7/024; E21B 3/02; E21B 7/046; E21B 7/04
See application file for complete search history.

(56) References Cited

U.S. PATENT DOCUMENTS

| | | | | |
|---|---|---|---|---|
| 3,930,668 | A | 1/1976 | Schuermann et al. | |
| 5,303,783 | A * | 4/1994 | Begnaud | E21B 7/046 175/203 |
| 5,555,947 | A * | 9/1996 | Bunker | E21B 7/046 175/122 |
| 6,179,065 | B1 | 1/2001 | Payne et al. | |
| 6,216,803 | B1 | 4/2001 | Deken | |
| 6,332,502 | B1 | 12/2001 | Mills et al. | |
| 6,497,296 | B1 | 12/2002 | McGriff et al. | |
| 6,814,164 | B2 | 11/2004 | Mills et al. | |
| 7,537,059 | B2 * | 5/2009 | Tjader | E21B 17/006 166/380 |
| 9,598,905 | B2 | 3/2017 | Van Zee et al. | |
| 9,945,180 | B2 * | 4/2018 | Hartke | E21B 7/046 |
| D851,688 | S * | 6/2019 | Cosgrove | D15/21 |

(Continued)

OTHER PUBLICATIONS

U.S. Appl. No. 62/783,382 filed with the U.S. Patent and Trademark Office on Dec. 21, 2018.

*Primary Examiner* — Taras P Bemko
(74) *Attorney, Agent, or Firm* — Mueting Raasch Group

(57) ABSTRACT

Embodiments of the present disclosure relate generally to underground horizontal directional drills and, more particularly, to aspects of drill operation, ground anchoring, and operator assistance features. In some embodiments, a drill is provided that includes an anchor assembly and/or a rear stabilizer that may pivot relative to a carriage frame of the drill. In other embodiments, a roller bearing system that permits the carriage to translate along the carriage frame is provided. In still other embodiments, rests to support the drill rod during makeup and breakout are described.

13 Claims, 15 Drawing Sheets

(56) References Cited

U.S. PATENT DOCUMENTS

| | | | | |
|---|---|---|---|---|
| 10,358,879 | B2 | 7/2019 | Maurer et al. | |
| 10,995,601 | B2 | 5/2021 | Guertin et al. | |
| 2007/0119623 | A1* | 5/2007 | Sewell | E21B 19/15 175/85 |
| 2011/0174545 | A1 | 7/2011 | Hartke et al. | |
| 2014/0144707 | A1* | 5/2014 | Hartke | E21B 15/006 175/57 |
| 2018/0363443 | A1* | 12/2018 | Guertin | E21B 19/15 |
| 2019/0338606 | A1 | 11/2019 | Metcalf et al. | |
| 2020/0102791 | A1 | 4/2020 | Sartori et al. | |

* cited by examiner

UNDERGROUND HORIZONTAL DIRECTIONAL DRILL

This application claims the benefit of U.S. Provisional Application No. 62/783,382, filed Dec. 21, 2018, which is incorporated herein by reference in its entirety.

Embodiments of the present disclosure relate generally to underground horizontal directional drills and, more particularly, to drill operation, drill anchoring, and drill operator assistance features.

BACKGROUND

Underground horizontal directional drills are known for forming horizontal boreholes beneath a ground surface, e.g., under a roadway or other obstruction. Typically, a horizontal directional drill includes a rod box adapted to hold a plurality of drill rods. These drill rods may be transferred, one rod at a time, from the rod box to a connection area of the drill where the rod may be attached to other drill rods to form a drill string. The drill string is attached to a drive system that may rotate and axially advance the drill string to form the horizontal borehole. Once the drill string is advanced, the most-recently added drill rod may be detached from the drive system, the drive system axially retracted, and another drill rod introduced into the connection area where it is then also connected to the drill string to extend the drill string length.

In addition to adding drill rod to the drill string, horizontal directional drills are also able to retract the drill string (e.g., conduct "backreaming" operations). As the drill string is retracted, the operator sequentially removes drill rods from the drill string and transfers the individual drill rods back to the rod box.

With smaller capacity drills, adding drill rods to and removing drill rods from the drill string may be accomplished via manual operator lifting and placement. As one can appreciate, such manual operation may be tedious. Moreover, the repetitive nature of such manual operation can present challenges to drill operation, particularly over extended periods of time.

Still further, prior to initiating drill operation, the operator typically secures the drill to the ground surface using an anchor system. For instance, the drill may include front and rear stabilizers that engage the ground surface and anchor the drill during operation.

While effective at stabilizing the drill, certain operations may necessitate positioning the drill cross-wise on a sloped surface. In such instances, conventional drills may ultimately operate in a tilted orientation. Alternatively, the operator may place shims between the ground and the stabilizers to true the orientation of the drill before boring operations.

SUMMARY

Embodiments described herein may provide a horizontal directional drill comprising: a chassis defining a front end and a rear end and a longitudinal axis extending between the front and rear ends; drive members adapted to propel the chassis over a ground surface; a drill drive system attached to the chassis and adapted to rotate and axially advance a drill string; and an anchor located proximate the front end of the chassis. The anchor includes a ground-engaging foot extending transversely to the longitudinal axis, wherein the foot is adapted to pivot about a pivot axis located at or near a transverse center of the foot.

In another embodiment, a horizontal directional drill is provided that includes: a chassis defining a front end and a rear end and a longitudinal axis extending between the front and rear ends; drive members adapted to propel the chassis over a ground surface; a drill drive system attached to the chassis and adapted to rotate and axially advance a drill string comprised of two or more rods connected to one another; and a front anchor located proximate the front end of the chassis. The front anchor includes a ground-engaging foot extending transversely to the longitudinal axis, wherein the foot is adapted to pivot about a pivot axis located at or near a transverse center of the foot. A rear stabilizer is also provided and located proximate the rear end of the chassis, wherein the rear stabilizer comprises a ground-engaging stabilizing foot also extending transversely to the longitudinal axis, and wherein the stabilizing foot is movable between a transport position and a ground-engaging position.

In yet another embodiment, a horizontal directional drill is provided that includes: a chassis defining a front end and a rear end and a longitudinal axis extending between the front and rear ends; drive members adapted to propel the chassis over a ground surface; a drill drive system attached to the chassis and adapted to rotate and axially advance a drill string comprised of two or more drill rods; a connection area where a drill rod is positioned when being connected to or disconnected from the drill string; and a front rest positioned proximate the front end and adapted to support a forward portion of each drill rod as it is being connected to or disconnected from the drill string.

In still another embodiment, a horizontal directional drill is provided that includes: a chassis defining a front end and a rear end and a longitudinal axis extending between the front and rear ends; drive members adapted to propel the chassis over a ground surface; and a carriage frame supported by the chassis, wherein the carriage frame is adapted to support a carriage. The carriage frame includes two parallel flanges interconnected to one another near their centers by a web. The drill also includes a drill drive system attached to the carriage. The drill drive system is adapted to translate the carriage along the carriage frame, wherein the carriage is coupled to the carriage frame by a pair of roller bearings. Both roller bearings of the pair of roller bearings are located between the two parallel flanges with one roller bearing of the pair of roller bearings being located adjacent a first side of the web, and another roller bearing of the pair of roller bearings being located adjacent a second side of the web.

The above summary is not intended to describe each embodiment or every implementation. Rather, a more complete understanding of illustrative embodiments will become apparent and appreciated by reference to the following Detailed Description of Exemplary Embodiments and claims in view of the accompanying figures of the drawing.

BRIEF DESCRIPTION OF THE VIEWS OF THE DRAWING

Exemplary embodiments will be further described with reference to the figures of the drawing, wherein.

Figure 1:
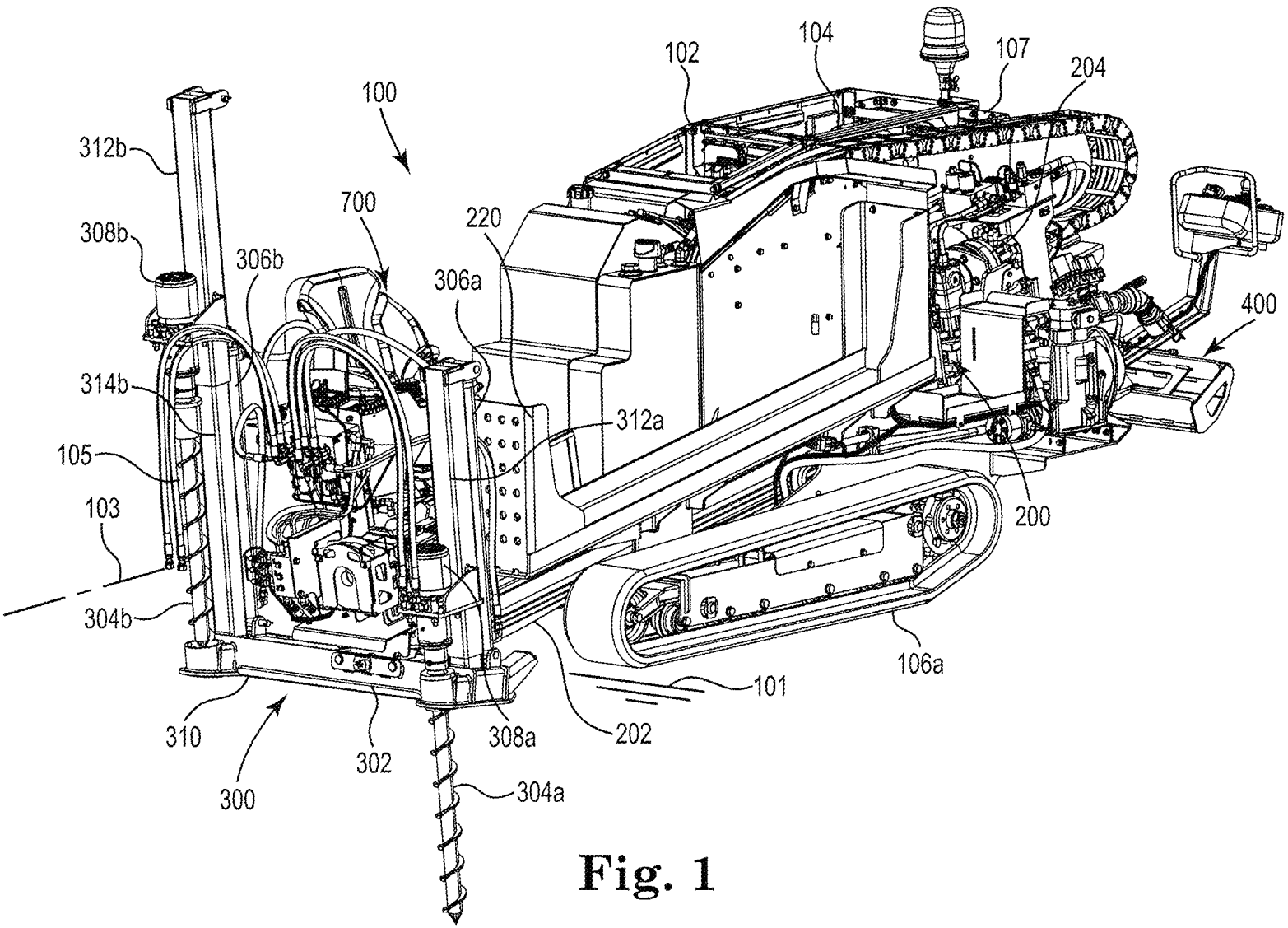
FIG. 1 is a front perspective view of an underground horizontal directional drill in accordance with embodiments of the present disclosure.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all of the views to better illustrate aspects of the depicted embodiments, or where inclusion of such structure/components is not necessary to an understanding of the various exemplary embodiments described herein. The lack of illustration/description of such structure/components in a particular figure is, however, not to be interpreted as limiting the scope of the various embodiments in any way.

DETAILED DESCRIPTION OF EXEMPLARY EMBODIMENTS

In the following detailed description of illustrative embodiments, reference is made to the accompanying figures of the drawing that form a part hereof. It is to be understood that other embodiments, which may not be described and/or illustrated herein, are certainly contemplated.

All headings provided herein are for the convenience of the reader and should not be used to limit the meaning of any text that follows the heading, unless so specified. Moreover, unless otherwise indicated, all numbers expressing quantities, and all terms expressing direction/orientation (e.g., vertical, horizontal, parallel, perpendicular, etc.) in the specification and claims are to be understood as being modified in all instances by the term "about." The term "and/or" (if used) means one or all of the listed elements or a combination of any two or more of the listed elements. "I.e." is used as an abbreviation for the Latin phrase id est and means "that is." "E.g." is used as an abbreviation for the Latin phrase exempli gratia and means "for example."

Embodiments of the present disclosure relate generally to underground horizontal directional drills. For example, drills in accordance with embodiments described herein may include an I-beam carriage frame for supporting a carriage used to advance a drill string, wherein the carriage incorporates large diameter roller bearings adapted to ride between flanges of the I-beam adjacent the I-beam web. In other embodiments of the present disclosure, a drill may be provided that includes a forward anchor adapted to anchor the drill to a ground surface. The anchor may attach to a carriage frame of the drill via a pivotal connection to allow pivotal movement of the anchor relative to the carriage frame. Such pivoting may occur about one or more axes. In still other embodiments, a drill may be provided that includes a rear stabilizer to assist with stabilizing the drill during boring operations. The stabilizer may include a foot that is pivotally attached to an arm of the stabilizer to allow pivoting of the foot about an axis extending generally along a longitudinal axis of the chassis. An actuator may be connected to the foot to permit controlled pivoting of the foot relative to the arm. Still further, embodiments of the present disclosure may include rests to assist an operator with manually positioning a drill rod before and during attachment of the drill rod to a drill string. The rests may include a rear rest located proximate the carriage, and/or a front rest proximate to or otherwise associated with a wrench.

It is noted that the terms "comprises" and variations thereof do not have a limiting meaning and are used in their open-ended sense to generally mean "including, but not limited to," where these terms appear in the accompanying description and claims. Further, "a," "an," "the," "at least one," and "one or more" are used interchangeably herein. Moreover, relative terms such as "left," "right," "front," "fore," "forward," "rear," "aft," "rearward," "top," "bottom," "side," "upper," "lower," "above," "below," "horizontal," "vertical," and the like may be used herein and, if so, are from the perspective of one operating the drill 100 while the drill is in an operating configuration, e.g., while the drill 100 is positioned such that tracks 106 rest upon a generally horizontal ground surface 101 as shown in FIG. 1. These terms are used only to simplify the description, however, and not to limit the interpretation of any embodiment described.

Still further, the suffixes "a" and "b" may be used throughout this description to denote various left- and right-side parts/features, respectively. However, in most pertinent respects, the parts/features denoted with "a" and "b" suffixes are substantially identical to, or mirror images of, one another. It is understood that, unless otherwise noted, the description of an individual part/feature (e.g., part/feature identified with an "a" suffix) also applies to the opposing part/feature (e.g., part/feature identified with a "b" suffix). Similarly, the description of a part/feature identified with no suffix may apply, unless noted otherwise, to both the corresponding left and right part/feature.

With reference to the figures of the drawing, wherein like reference numerals designate like parts and assemblies throughout the several views, FIG. 1 illustrates a horizontal directional drill 100 in accordance with embodiments of the present disclosure. As shown in FIG. 1, drill 100 may include a drill chassis 102 supported for transport over the ground surface 101 by two ground-engaging drive members, which in some embodiments comprise endless tracks 106 (only left track 106*a* visible in FIG. 1, but see track 106*b* in FIG. 10). As is known in the art, the tracks may be powered to selectively propel the chassis 102 over the ground surface 101. The chassis 102 also supports a prime mover (which may be configured as an internal combustion engine 104 or electric motor) operable to power not only the tracks, but a drill drive system (further described below) as well. As shown in FIG. 1, the drill 100 may define a front end 105, a rear end 107, and a longitudinal axis 103 extending between the front and rear ends.

Figure 2:
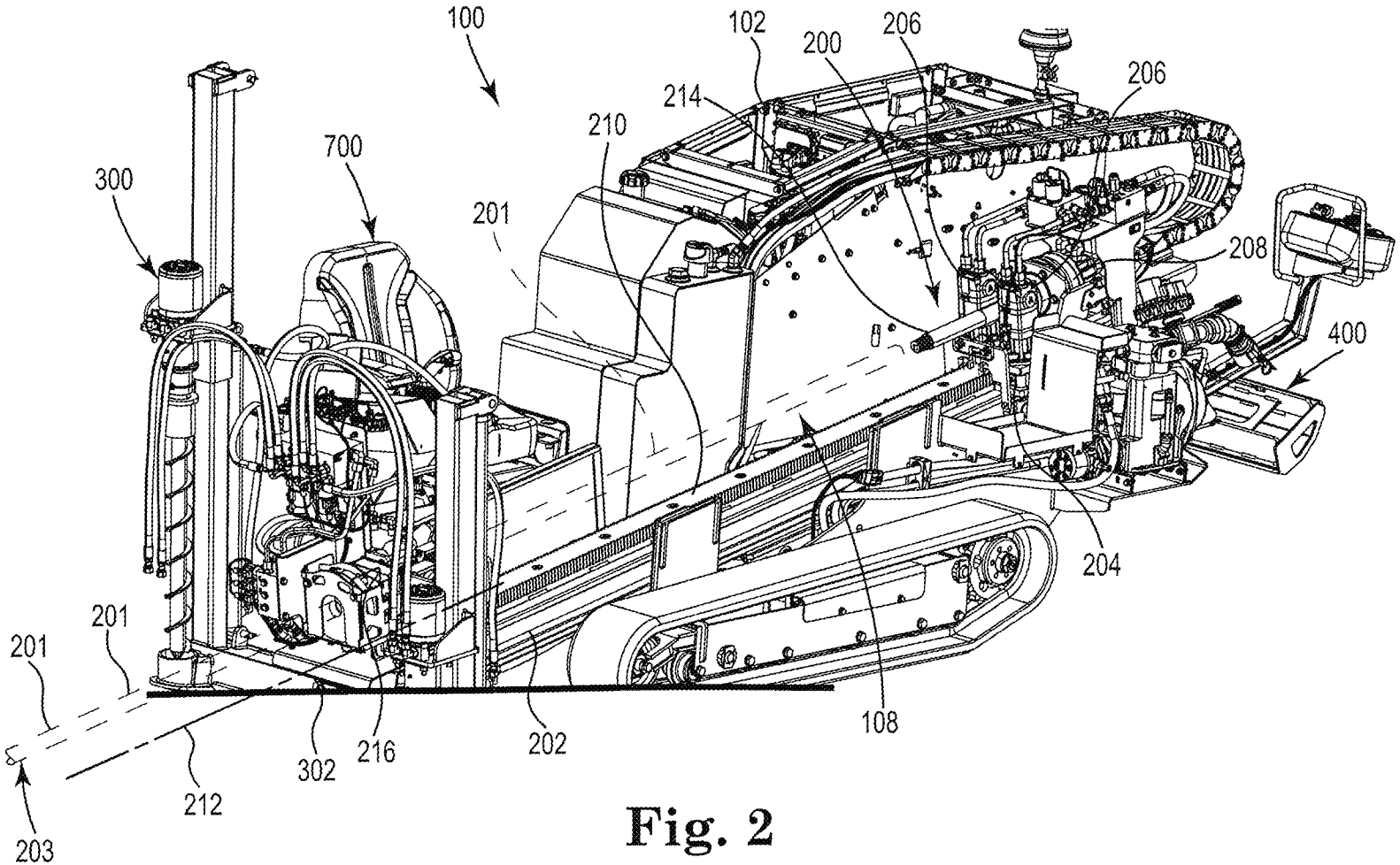
FIG. 2 is a perspective view similar to FIG. 1, but with some structure removed to better illustrate embodiments of the present disclosure.

As perhaps best illustrated in FIGS. 1 and 2, the drill 100 may further include a drill carriage assembly 200. As shown in these views, the drill carriage assembly 200 includes a carriage frame 202 supported by the chassis 102. The carriage frame 202 may be attached to the chassis 102 such that the carriage frame may change its angular orientation (e.g., pivot) relative to the chassis to thereby alter an angle at which the drill string penetrates the ground surface 101.

The drill carriage assembly 200 may further include a carriage 204 supported by, and translatable along, the carriage frame 202. In some embodiments, the carriage 204 may operatively support a pair of thrust generators 206 and a torque generator 208, which together form a drill drive system adapted to rotate and axially advance (or retract) the carriage and thus the drill string 203 (see FIG. 2). The thrust generators 206 are, in the illustrated embodiments, secured on opposing sides of a thrust rack 210. Thrust generators 206, may selectively rotate pinion gears (not shown) that engage corresponding rack gears located along the thrust rack 210. That is to say, the thrust rack 210 may form a longitudinal track extending along a longitudinal axis 212, wherein the track includes rack gears on opposite sides. The carriage 204 may then translate along the rack 210/longitudinal axis 212 by actuation of the thrust generators 206.

The torque generator 208, which is also carried by the carrier 204, forms a drill spindle 214 having a threaded end adapted to threadably mate with a drill rod as is known in the art. When actuated, the torque generator 208 may rotate the spindle to: perform makeup (add drill rods to the drill string) and breakout (remove rods from the drill string) operations; and rotate the drill string as it is advanced or retracted. Moreover, the torque generator may be used to hold the drill string during thrusting, e.g., to control steering of the drill string. In the illustrated embodiments, the torque generator 208 and thrust generators 206 are hydraulic motors, but may be most any other type of actuator. For example, an electric motor (with or without a transmission) may be substituted for any of the torque generators and thrust generator.

A connection area 108 may be formed between the drill spindle 214 and a wrench 216 (the latter used to hold drill rod during makeup and breakout). Drill rods 201 may be positioned within the connection area 108 when added to or removed from the drill string. In the exemplary drill 100 illustrated in FIG. 1, drill rods may be stored until needed in a rod box 220 (shown empty in FIG. 1 and removed in FIG. 2). To move drill rod 201 from the rod box 220 to the connection area and vice-versa, an operator standing in or near an operator station 700 may manually grasp a drill rod from the rod box 220 (or connection area 108) and transfer it to the connection area (or rod box).

Exemplary embodiments of the drill 100 may further include an anchor or anchor assembly 300 located proximate the front end 105 of the chassis 102. The anchor assembly 300 includes an anchor frame 302 that is operatively connected to the carriage frame 202. In some embodiments, the anchor frame 302 may operatively support left and right anchor screws 304 (304*a*, 304*b*). Each anchor screw 304 may be attached to a corresponding thrust generator 306 (e.g., 306*a*, 306*b*), and to a torque generator 308 (308*a*, 308*b*). In some embodiments, the thrust generators 306 are each configured as linear hydraulic cylinders, while the torque generators 308 may each be configured as hydraulic rotary motors (although other embodiments may substitute other generators, e.g., electric ball screws, electric motors, etc., alone or paired with a mechanical system (e.g., transmission, worm gear, rack and pinion, screw, or draw bolt) without departing from the scope of this disclosure).

Figure 3:
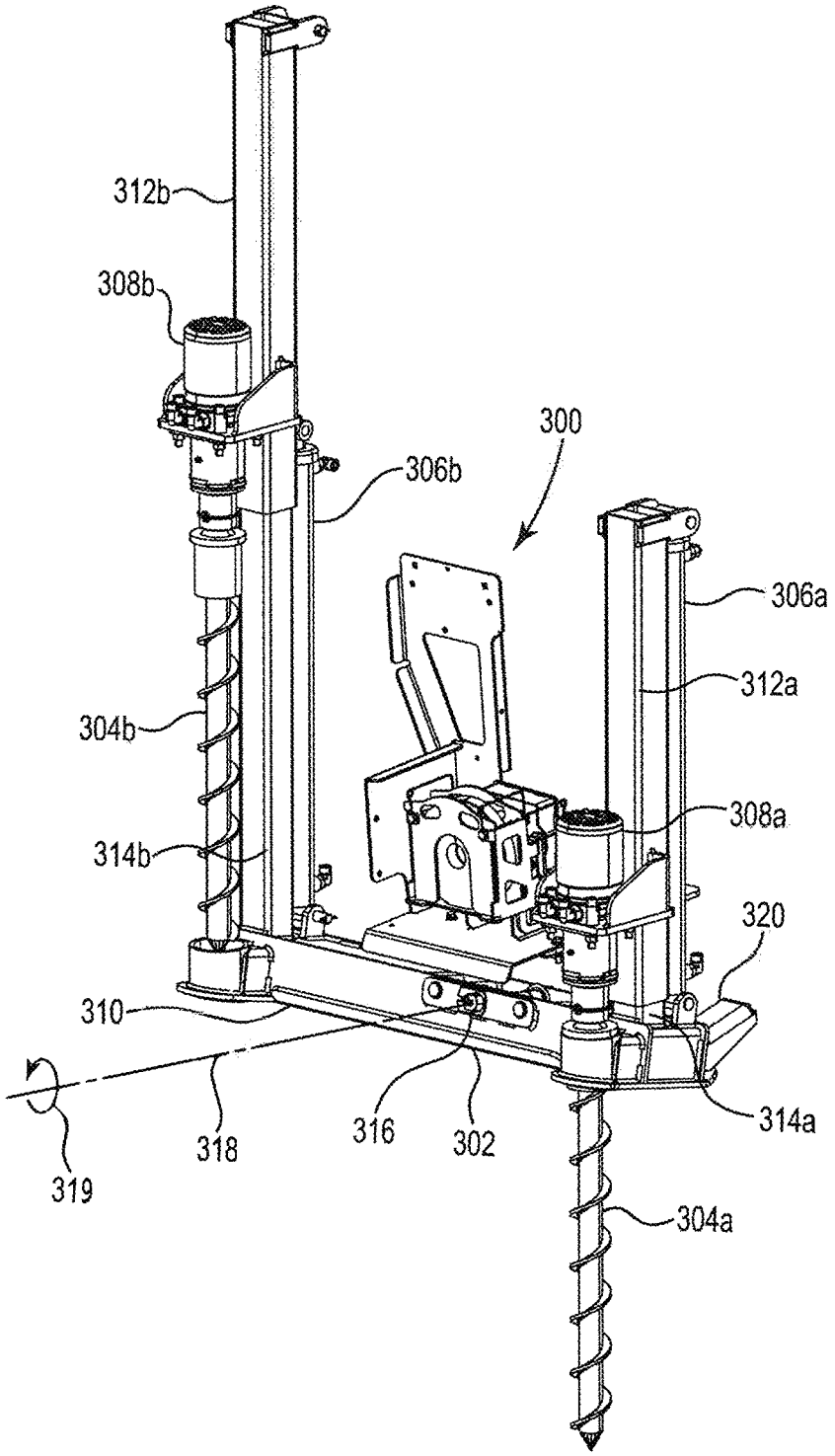
FIG. 3 is a perspective view of an anchor assembly in accordance with one embodiment of the present disclosure, the anchor assembly shown isolated from the drill.

The anchor assembly 300 may also include a ground-engaging foot 310 extending generally transversely to the longitudinal axis 103 of the chassis 102. As shown in FIG. 3, the foot is adapted to pivot about a pivot axis 318 located at or near a transverse center of the foot as further described below. Each thrust generator 306 may have a first (cylinder) end attached to the foot 310, and a second (rod) end attached to a tubular sleeve 312 that telescopically slides along a guide 314. The screw 304 and torque generator 308 may be operatively attached to the corresponding sleeve 312 such that actuation of the thrust generator may cause the associated screw (and the torque generator) to move parallel to the respective guide 314. Each torque generator 308 may connect to its associated anchor screw 304 such that actuation of the torque generator causes corresponding rotation of the associated screw. Extension of the thrust generators 306 and actuation of torque generators 308 can thus cause the screws 304 to rotate and penetrate to a desired depth within the ground surface 101. In other words, simultaneous actuation of generators 306 and 308 may drill screws 304 into the ground, thereby securing the foot 310 (and thus the chassis 102) to the ground surface 101. Actuation of the thrust and torque generators may be controlled by an operator positioned in or near the operator station 700 (see FIG. 1), or via remote (wired or wireless) control.

While shown in FIGS. 1-3 as utilizing two torque generators and two thrust generators, other anchor assemblies may include any number of thrust generator(s), torque generator(s) and anchor screw(s) without departing from the scope of this disclosure. Further, embodiments that utilize one thrust and one torque generator to drive multiple screws are also contemplated.

With known drills, the anchor assembly is attached to the carriage frame 202 such that an orientation of the foot is fixed relative to the chassis 102. Accordingly, when such drills are located across an inclined surface (e.g., hill), the foot will anchor flush with the ground surface, potentially positioning the chassis 102 in a tilted orientation. In some instances, the foot may be shimmed on one side before anchoring to assist with leveling the drill before operation.

Embodiments of the present disclosure may, however, avoid the need for shimming in such circumstances by providing a pivotal connection between the anchor frame 302 and the carriage frame 202. For example, as shown in FIG. 3, the anchor frame 302 may connect to the carriage frame 202 via a pivot 316 that permits pivoting of the anchor frame relative to the carriage frame about the pivot axis 318, the latter extending generally between the front and rear ends 105, 107 of the chassis (but not necessarily parallel to the longitudinal axis 103 of the chassis 102). As a result, the foot 310 may assume various angular orientations relative to the carriage frame 202. For instance, in some embodiments, the pivot 316 may allow pivoting +/−20 degrees or less about the axis 318.

In some embodiments, the anchor assembly 300 may be biased about the pivot axis 318, which may, in some embodiments, be vertically aligned with an axis of the drill string (e.g., both axes may lie within a common vertical plane). For example, the configuration of the anchor assembly 300 may be such that the anchor assembly, when unconstrained, tends to pivot in the direction 319 shown in FIG. 3. To limit pivotal motion of the anchor assembly 300 when the latter is raised, the anchor frame 302 may include a stop 320 adapted to contact the carriage frame 202 and/or the chassis 102 when the carriage frame is moved toward a horizontal transport position. Once again, the bias of the anchor frame tends to keep the stop 320 in contact with the carriage frame 302, reducing the occurrence of anchor rocking during drill transport. In some embodiments, springs (not shown) may bias the anchor frame 302 rotationally about the pivot 316 until it rests against structure (e.g., the carriage frame 202) when not in use. Such a configuration permits the drill 100 to be transported while minimizing undesirable movement of the anchor frame 302.

Figure 4:
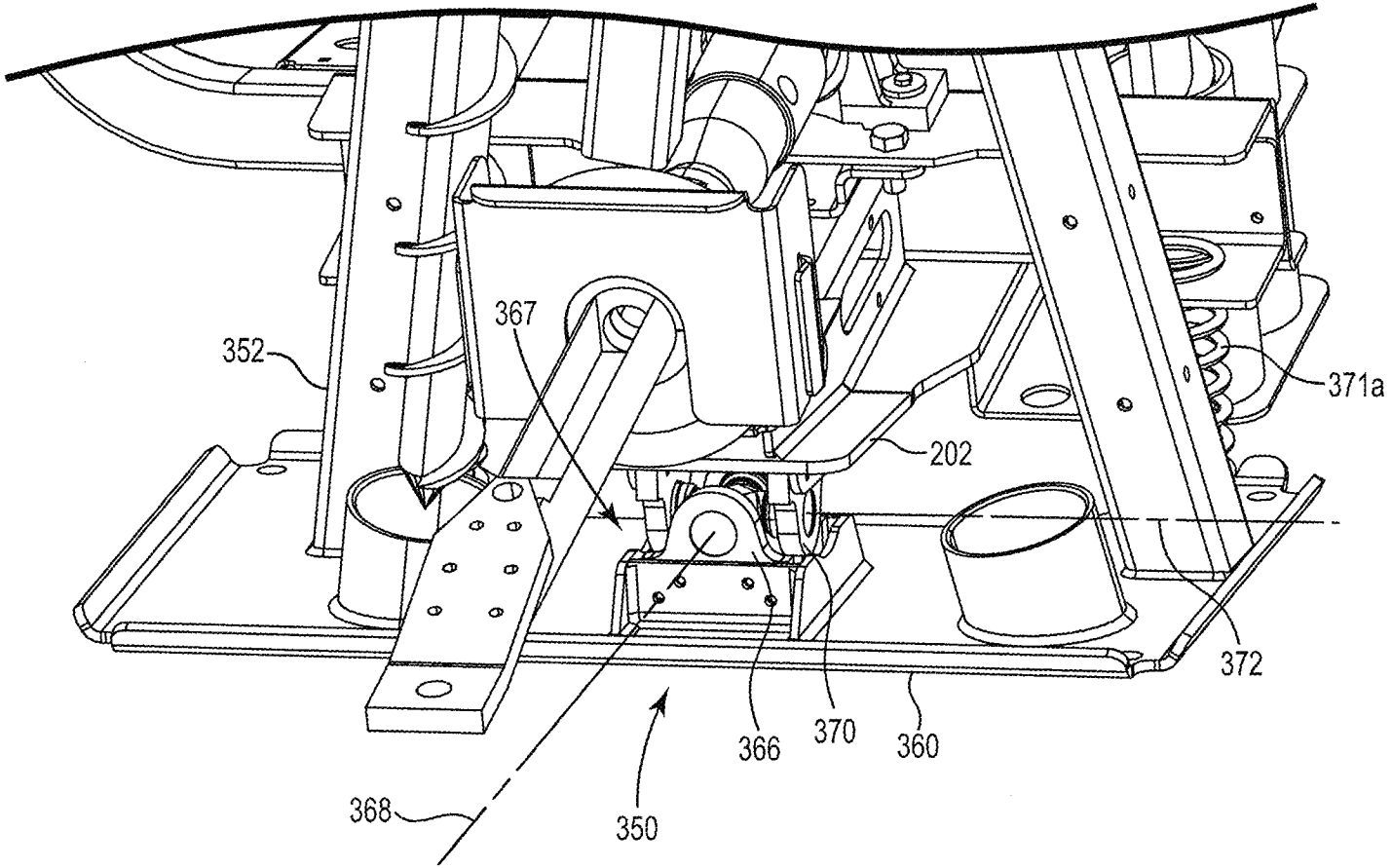
FIG. 4 is a partial perspective view of an anchor assembly in accordance with another embodiment of the present disclosure.

While the pivot 302 allows pivoting about a single, generally fore-and-aft axis 318 (the actual orientation of the axis 318 may vary somewhat depending on the position of the carriage frame 202), such a configuration is not limiting. For example, the anchor assembly 350 shown in FIG. 4 may again include a frame 352 having a foot 360. However, unlike the anchor assembly 300, the anchor assembly 350 may be pivotally attached to the carriage frame 202 by a dual pivot assembly 367 defining pivot 366 (for pivoting about a first pivot axis 368) and secondary pivot 370 (for pivoting about a secondary pivot axis 372 orthogonal to the first pivot axis 368). As one of skill can appreciate, such a dual pivot arrangement allows pivoting of the foot 360 during the anchoring process about both a longitudinal (fore-and-aft) axis and a transverse (left-to-right extending) axis. Moreover, the anchor assembly 350 may provide consistent anchor-to-ground engagement even as the angle of the drill string/carriage assembly 200 relative to the ground surface changes. As shown in FIG. 4, springs 371 (only left spring 371*a* visible, but a corresponding right spring may also be provided) may stabilize the anchor assembly 350 during transport.

Figure 5:
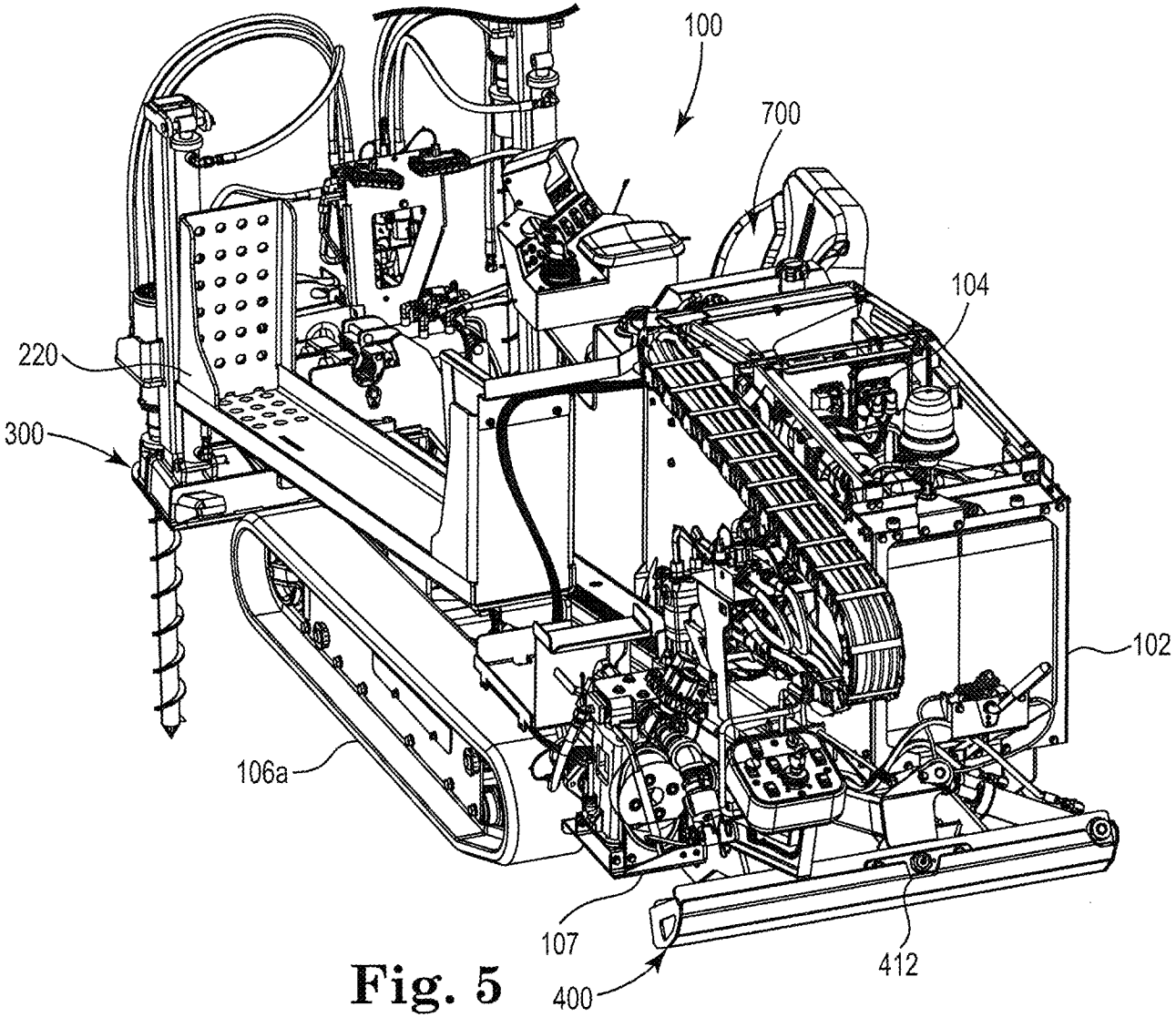
FIG. 5 is a rear perspective view of an underground horizontal directional drill in accordance with embodiments of the present disclosure.

With reference to FIG. 5, a rear stabilizer ("stabilizer assembly") 400 may also be included and located proximate the rear end 107 of the chassis 102. The rear stabilizer may, in concert with the anchor assembly (e.g., anchor assembly 300, 350), be used to immobilize and stabilize the drill 100 during boring operations.

Figure 6:
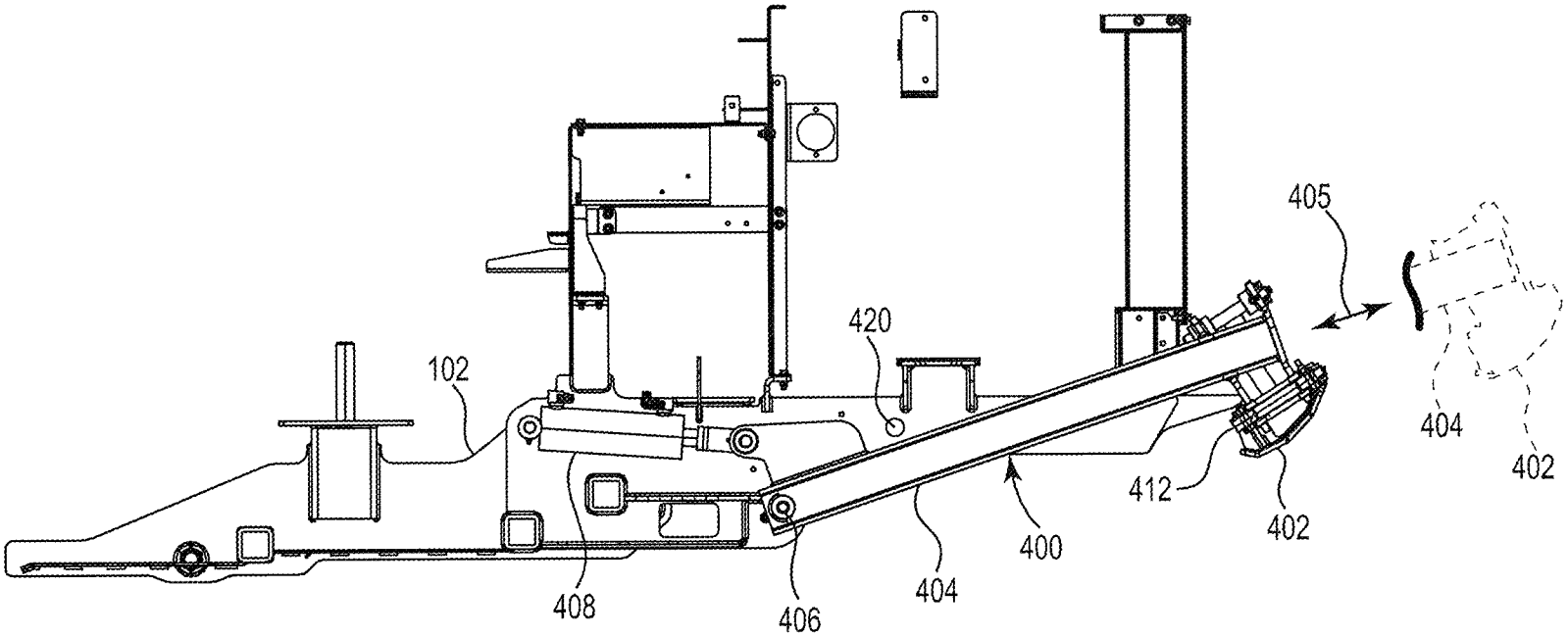
FIG. 6 is a partial side section view of the drill of FIG. 5 illustrating a rear stabilizer in a first or transport position.
Figure 7:
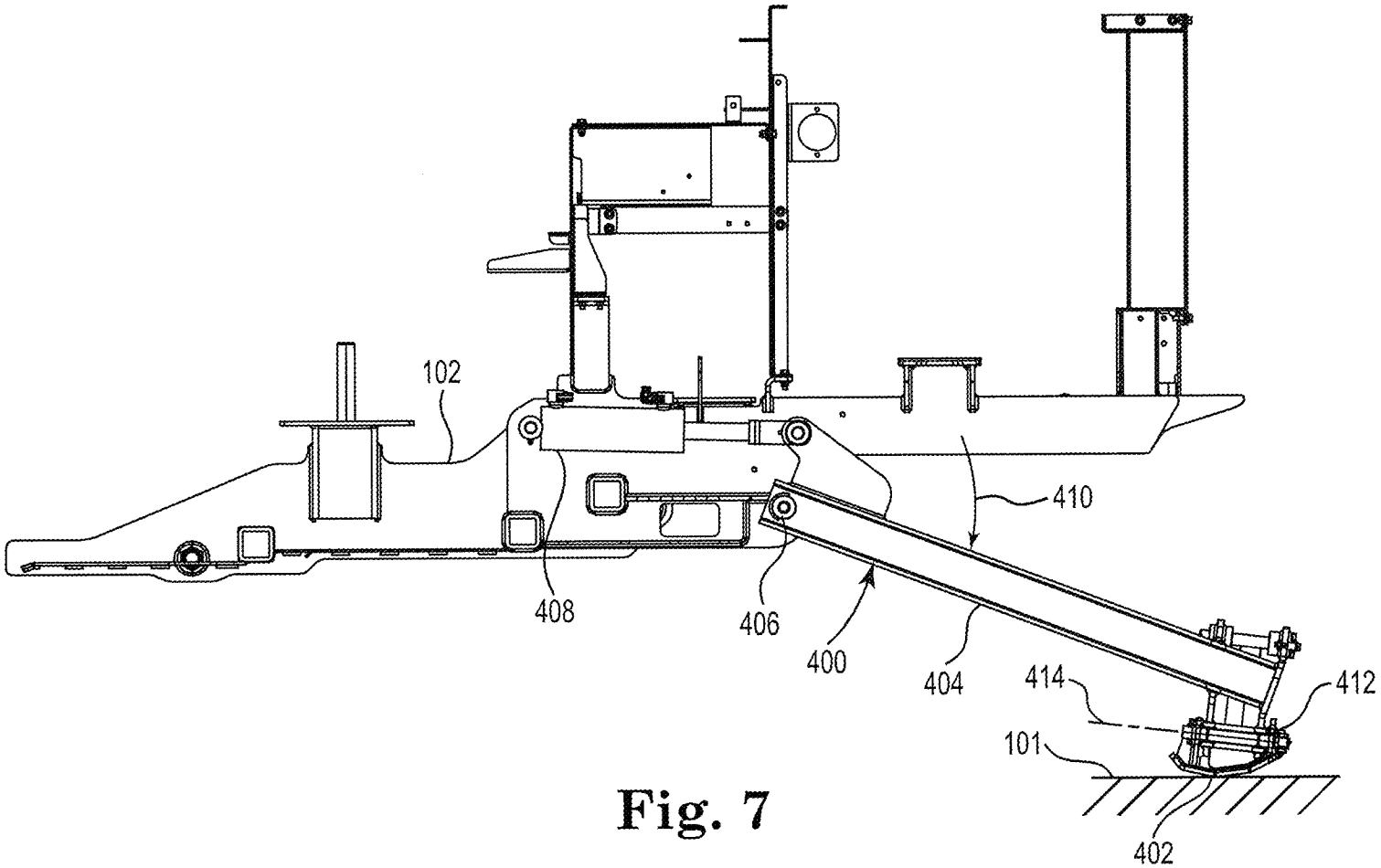
FIG. 7 is a partial side section view similar to FIG. 6, but showing the rear stabilizer in a second or stabilizing position.

FIGS. 6 and 7 are partial cross-sectional views of the drill 100 (taken along a vertical plane extending in a fore-and-aft direction of the drill) with various structure removed to better illustrate the rear stabilizer assembly 400. FIG. 6 illustrates the assembly 400 with a ground-engaging stabilizing foot 402 shown in a first or transport position, while FIG. 7 illustrates the assembly 400 once moved to place the foot in a second or ground-engaging position. As shown in these views, the assembly 400 may include the stabilizing foot 402 attached to an elongate arm 404, wherein the foot extends generally transversely to the longitudinal axis 103 (see FIG. 1). The arm 404 extends rearwardly from the chassis 102 and is pivotally attached thereto at a transverse pivot 406. An actuator 408 may be connected between the chassis 102 and the arm 404 as shown. In some embodiments, the actuator 408 is a linear hydraulic cylinder, although other actuators such as rotary motors (electric or hydraulic) are also contemplated.

When the actuator 408 is extended from a retracted position shown in FIG. 6, to an extended position shown in FIG. 7, the arm 404 moves in the direction 410, allowing the foot 402 to move between the transport position and the ground-engaging position, wherein the latter position causes the foot to exert a downward force upon the ground surface 101.

Figure 8:
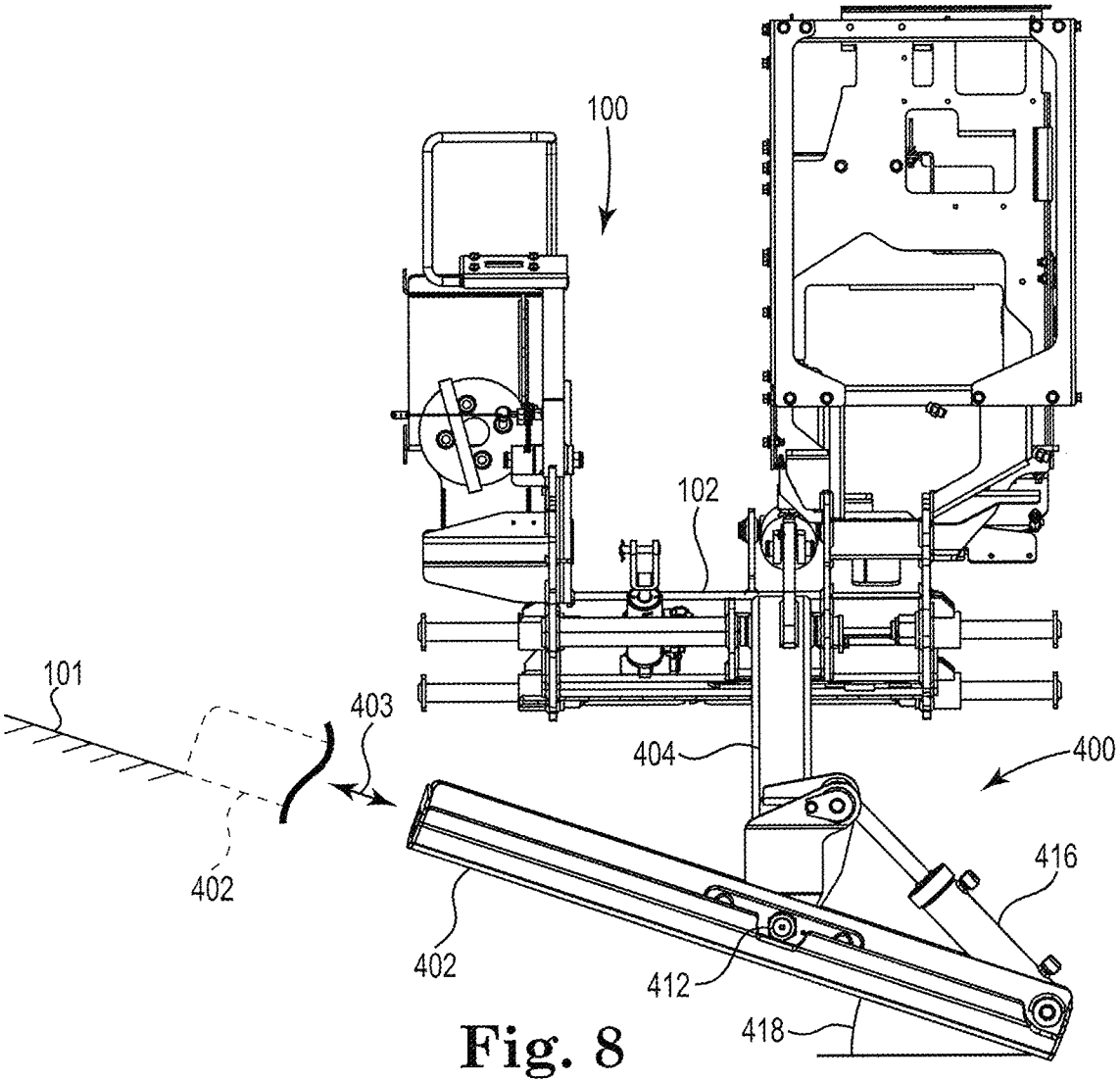
FIG. 8 is a partial rear view of the drill of FIG. 7 after adjustment of a transverse angle of a foot of the rear stabilizer.

Similar to the foot 302 of the anchor assembly 300, the foot 402 of the rear stabilizer assembly 400 may pivotally attach to the arm 404 via an arm pivot 412 to permit pivoting of the foot about an axis 414. However, unlike the passive pivot 316 of the anchor assembly 300, the foot 402 may be actively pivoted about the axis 414 via an actuator 416 as shown in FIG. 8. As with other linear actuators described herein, the actuator 416 may, in one embodiment, be configured as a linear hydraulic cylinder or manual actuator. However, such a configuration is not limiting. As shown in FIG. 8, the actuator 416 may apply a force to the foot 402 sufficient to cause it to pivot from a horizontal orientation to a foot angle 418 corresponding to a slope of the ground surface 101. That is to say, the actuator 416 is adapted to change the orientation of (or otherwise pivot) the stabilizing foot 402, about the arm pivot 412, relative to the arm 404.

Although not illustrated herein, the foot 402 may optionally include an internal mechanism (e.g., linear actuator) that permits a length of the foot (see, e.g., transverse length of foot in FIG. 8) to be adjusted (lengthened and shortened) as needed (while shown as being adjustable on one side only, other embodiments may allow both (left and right) sides of the foot to extend and retract). That is to say, the transverse width of the foot 402 (as viewed in FIG. 8) may be extended or retracted (see, e.g., arrows 403 in FIG. 8) where such change benefits operation (e.g., extended for steeper slopes). Similarly, other embodiments may, in addition or alternatively, allow a length of the arm 404 to be adjusted (lengthened and shortened) in a direction along an axis of the arm (e.g., generally along the longitudinal axis 103 of the drill) as indicated by arrows 405 in FIG. 6. Such capability may further assist in providing versatile stabilization capabilities.

Figure 9:
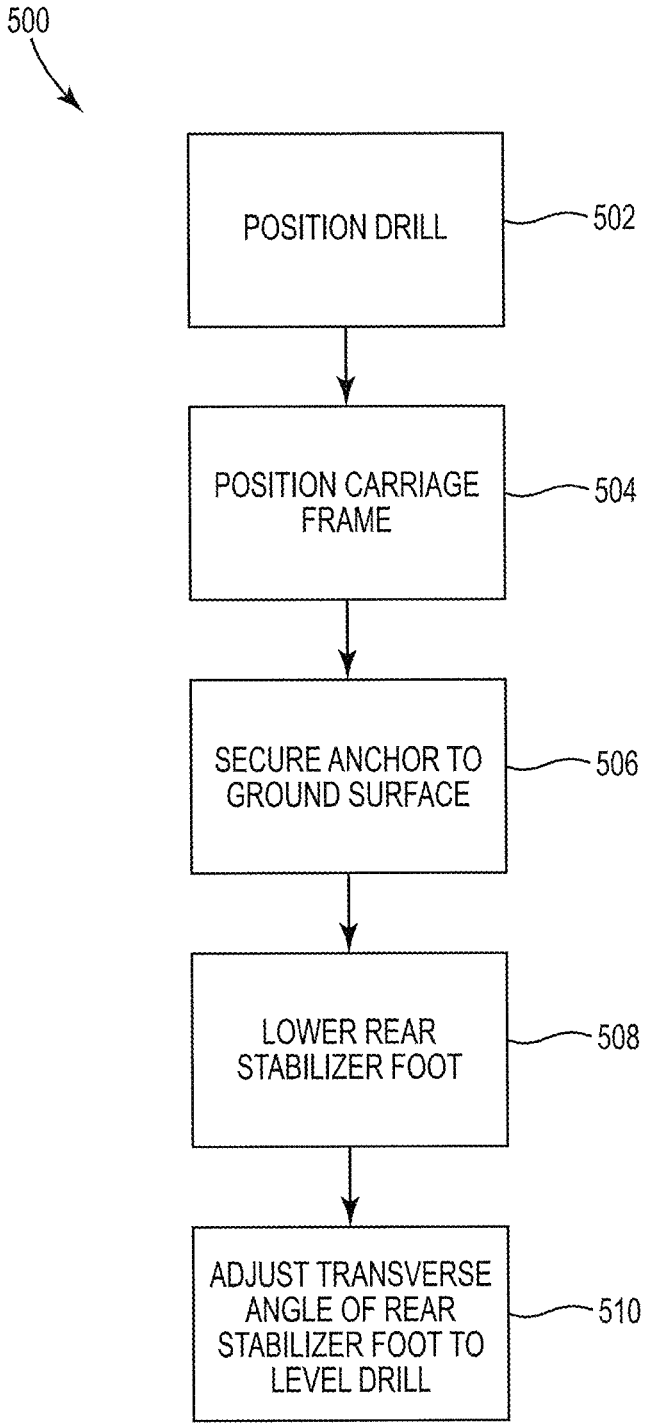
FIG. 9 illustrates an exemplary procedure of leveling an underground horizontal directional drill upon a sloped surface in accordance with embodiments of the present disclosure.

In embodiments that include both the floating front anchor assembly 300 (or 350) and the rear stabilizer assembly 400, it is thus possible to position the drill across a sloped surface and then, using the rear stabilizer, level the drill prior to boring operations. FIG. 9 illustrates such an exemplary procedure 500. As shown in this view, the drill 100 may first be positioned as indicated at 502. The carriage frame 202 may then be adjusted to provide the desired boring angle at 504. The anchor assembly 300 may then be secured (staked) to the ground surface using the screws 304 (see FIG. 1) at 506. As the screws rotate, they pull the anchor foot 302 into engagement with the ground surface 101 by pivoting about the pivot 316 (see FIG. 3). Assuming the drill is positioned crosswise on a sloped surface, the foot 302 can, in some embodiments, pivot sufficiently to provide engagement across its entire ground contact surface.

Once the anchor assembly 300 is secured at 506, the rear stabilizer assembly 400 may be lowered (using the actuator 408; see FIGS. 6-7) until the foot 402 engages the ground surface 101 at 508. At this point, the actuator 416 may be actuated to extend, thus pivoting the foot 402 at 510 until the drill 100 is generally level as shown in FIG. 8. Drill operation may then proceed with the drill chassis 102 in this generally level orientation upon the sloped ground surface 101.

In some embodiments, the rear stabilizer assembly 400 may include a switch or sensor adapted to indicate the arm 404 is approaching its transport position shown in FIG. 6.

For example, a proximity switch 420 or an actuator rod position sensor (not shown) may generate a signal representative of the arm 404 being near its transport position. The switch 420 may then provide a signal to a relief valve associated with the actuator 416 (see FIG. 8). The signal may cause the relief valve to open and permit hydraulic fluid in the cylinder to relieve. As a result, if the rear stabilizer assembly 400 is raised with the foot in a tilted orientation as shown in FIG. 8, the relieve valve may permit the actuator to "float" once the foot 402 contacts the chassis 102. The ability to allow the actuator 416 to float in these circumstances may minimize potential damage or interference should the rear stabilizer assembly 400 be moved to the transport position (see FIG. 6) before the actuator 416 is first retracted.

Figure 10:
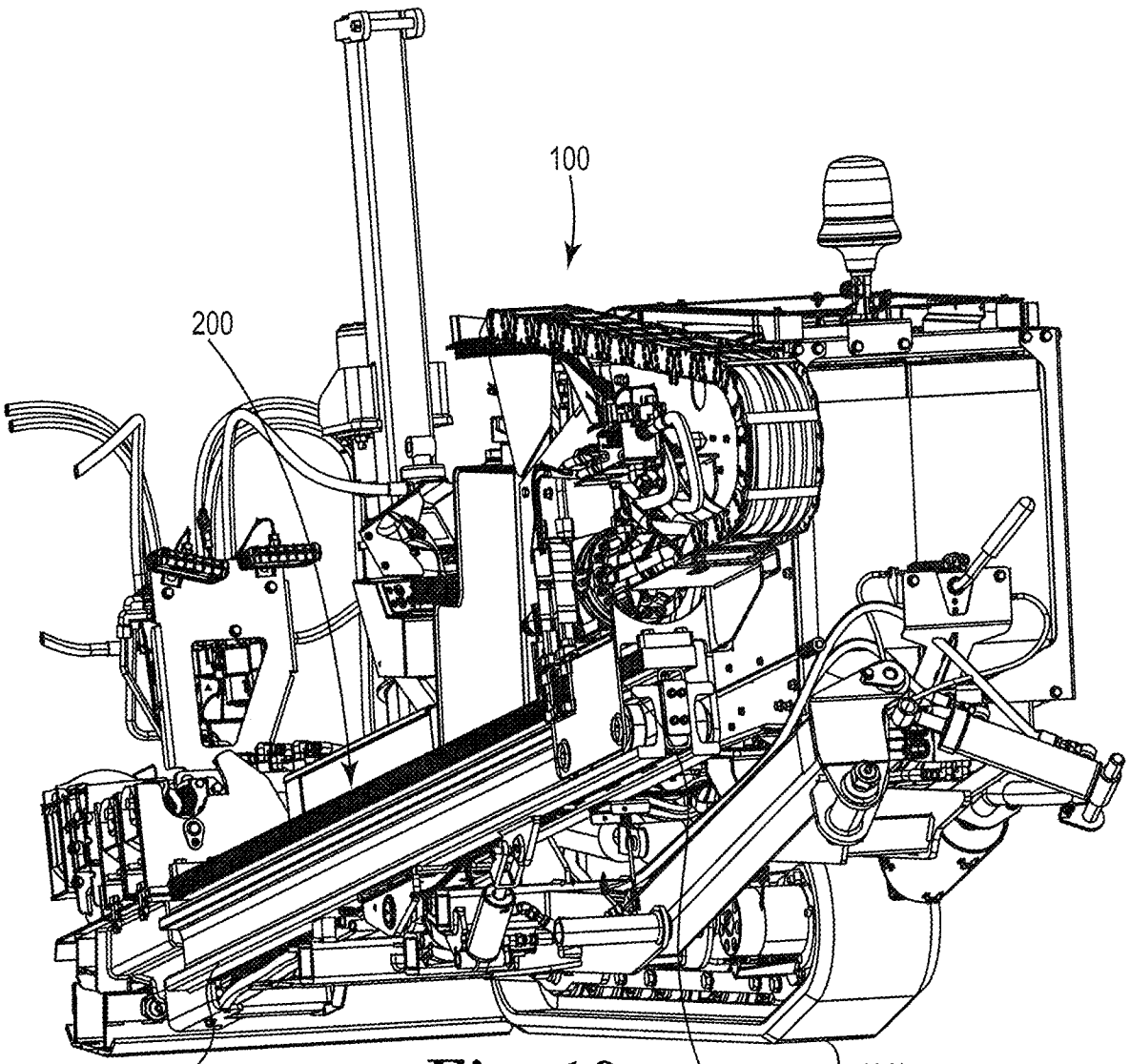
FIG. 10 is a perspective section view of the drill of FIG. 1 illustrating a carriage construction in accordance with embodiments of the present disclosure.
Figure 11:
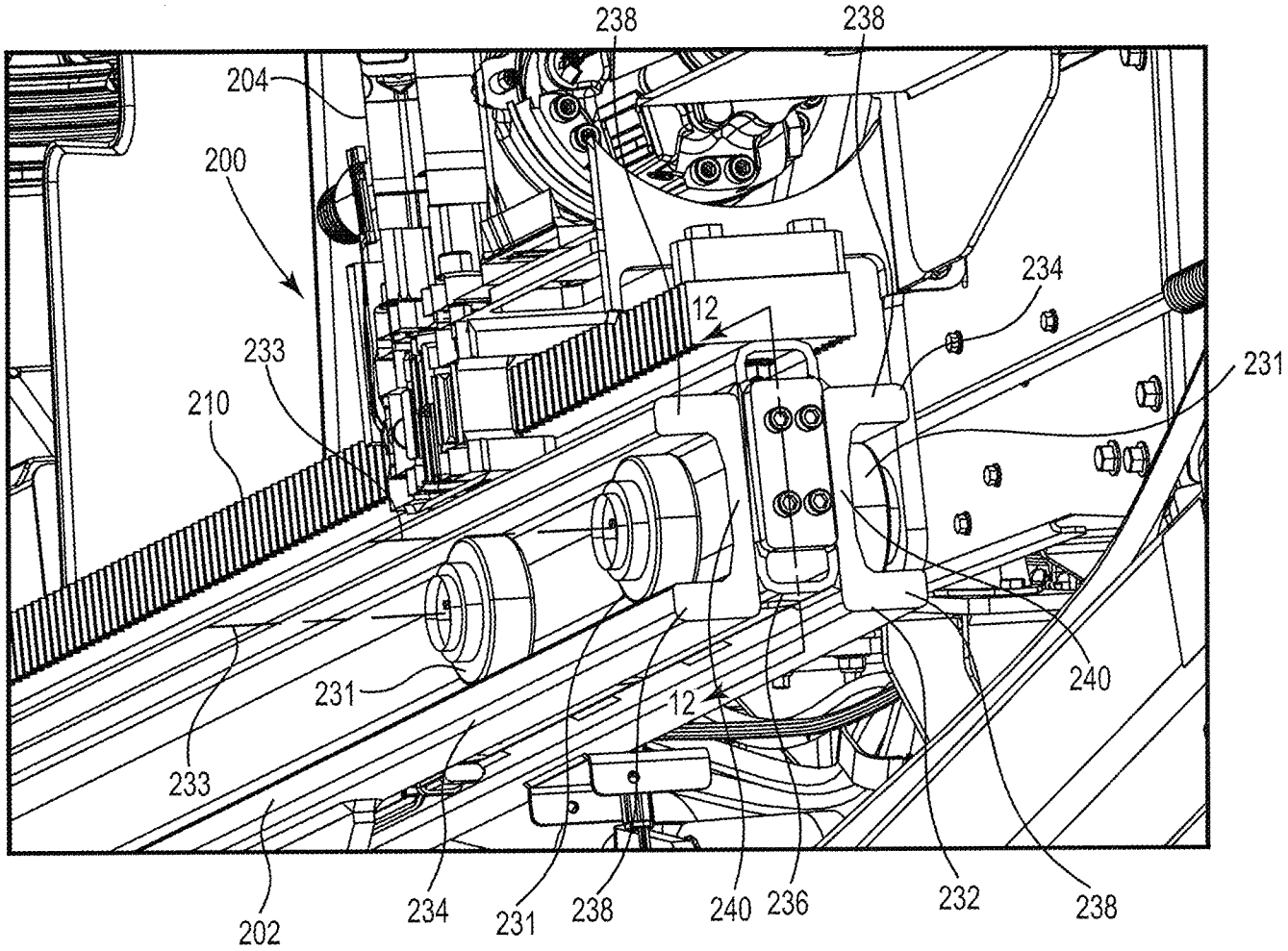
FIG. 11 is an enlarged section view similar to FIG. 10 with some structure removed to better illustrate carriage roller bearings.
Figure 12:
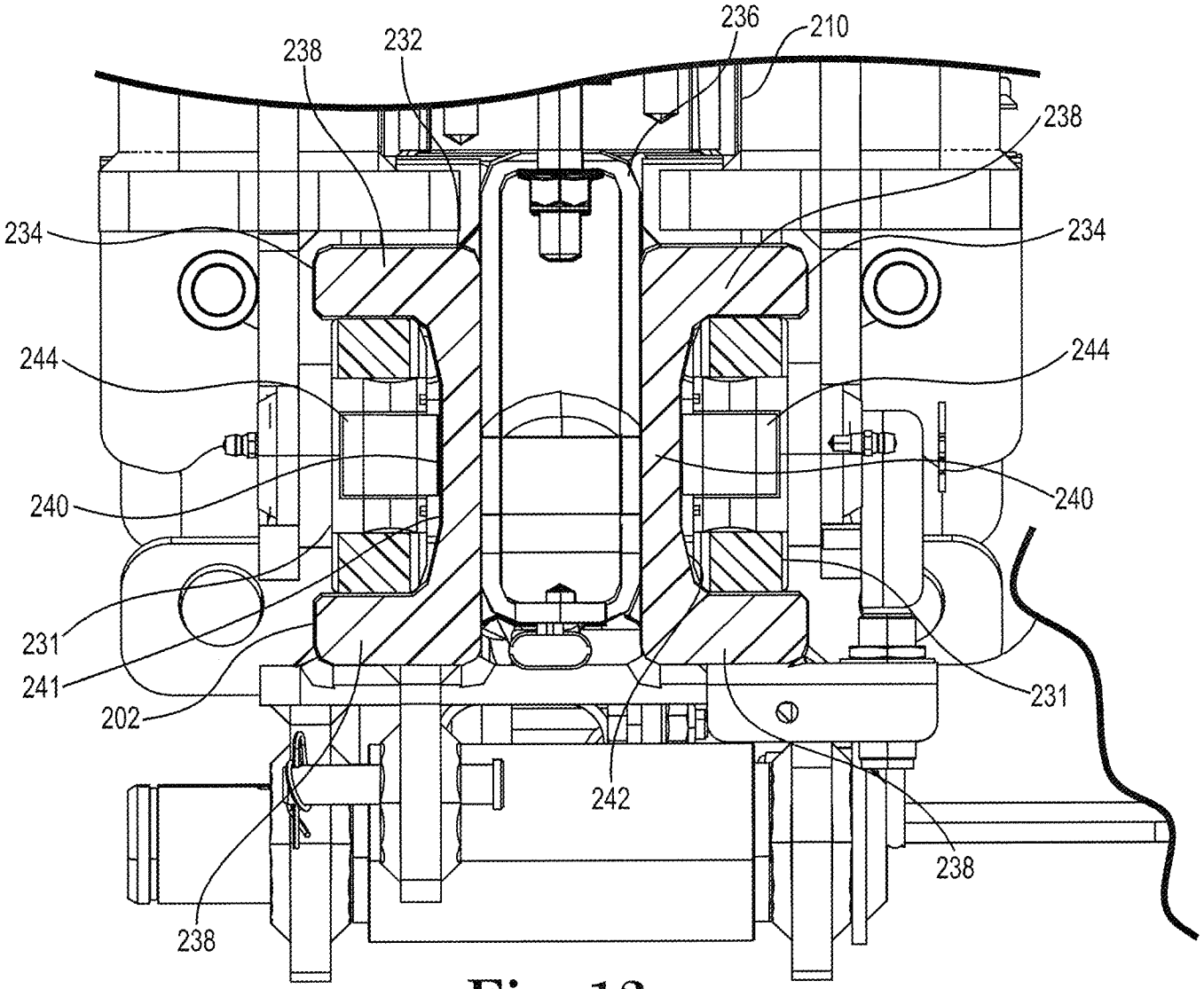
FIG. 12 is a section view taken along line 12-12 of FIG. 11.

FIGS. 10-12 illustrate the carriage assembly 200/carriage 204 in accordance with embodiments of the present disclosure. In particular: FIG. 10 is a longitudinal vertical cross section of the drill illustrating portions of the carriage frame 202 and carriage 204; FIG. 11 is a similar, enlarged view with portions of the carriage 204 removed to better illustrate roller bearings 231 used to allow the carriage to translate along the carriage frame 202; and FIG. 12 is a cross sectional view taken along line 12-12 of FIG. 11.

As indicated in the figures, the carriage frame 202 may generally form an I-beam 232. In the illustrated embodiments, this shape is produced by two U-shaped channels 234 secured to opposite sides of a chassis rail 236. The chassis rail 236 may be included to allow attachment of the thrust rack 210 as shown. While shown with the intermediate chassis rail 236, other embodiments may form the beam 232 from a conventional I-beam.

The I-beam configuration of the carriage frame 202 effectively provides two (e.g., top and bottom) parallel flanges 238 interconnected to one another near their centers by a web 240. In the illustrated embodiments, the web 240 is defined by the vertical portions of both channels 234 and the optional chassis rail 236. The carriage 204 is, in some embodiments, coupled to the carriage frame 202 by one or more pairs of roller bearings 231, wherein both roller bearings 231 of each pair of roller bearings are located between the two parallel flanges 238 with one roller bearing of the pair being located adjacent a first side 241 of the web 240, and another of the pair of roller bearing being located adjacent a second side 242 of the web.

In the illustrated embodiments, the carriage includes a second pair of roller bearings 231 situated similar to, and longitudinally offset from, the first pair described above (e.g., both of the second pair of roller bearings being located between the two parallel flanges, with one roller bearing of the second pair of roller bearings being located adjacent the first side of the web, and the other being located adjacent the second side of the web). Each bearing of the second pair of roller bearings is adapted to bear against both of the flanges 238 (both the upper and lower flanges in FIG. 12).

The roller bearings 231 are each adapted to rotate about an axis 233 orthogonal to the web 240 such that the bearings allow the carriage to roll along the carriage frame 202 during operation. As each bearing 231 is adapted to bear against adjacent surfaces of both (upper and lower) flanges, the carriage may resist unintended motions (e.g., all motions except those along the carriage frame). In addition to the roller bearings 231, the carriage frame 202 may further include a transverse roller bearing 244 associated with one or more of the pair of roller bearings 231, wherein the transverse roller bearings 244 are adapted to bear against the web 240 (e.g., against sides 241, 242).

By locating the roller bearings inside of the flanges 238 (as opposed to providing smaller bearings sandwiching a single flange), a larger diameter bearing may be utilized. The larger diameter may be able to function more effectively than small-diameter bearings in the debris-heavy environments common with horizontal directional drilling operations. Moreover, use of larger bearings 231 allows fewer bearings to be used, potentially simplifying assembly and manufacturing costs. While not wishing to be bound to a specific roller bearing size, a roller bearing 231 outer diameter of 50 millimeters (mm) to 100 mm is contemplated, such as, for example, bearings of 75 mm to 100 mm, e.g., 88 mm, in diameter. In the illustrated embodiments, the roller bearings may also have an overall width of 20 mm to 40 mm, e.g., 30 mm.

Figure 13:
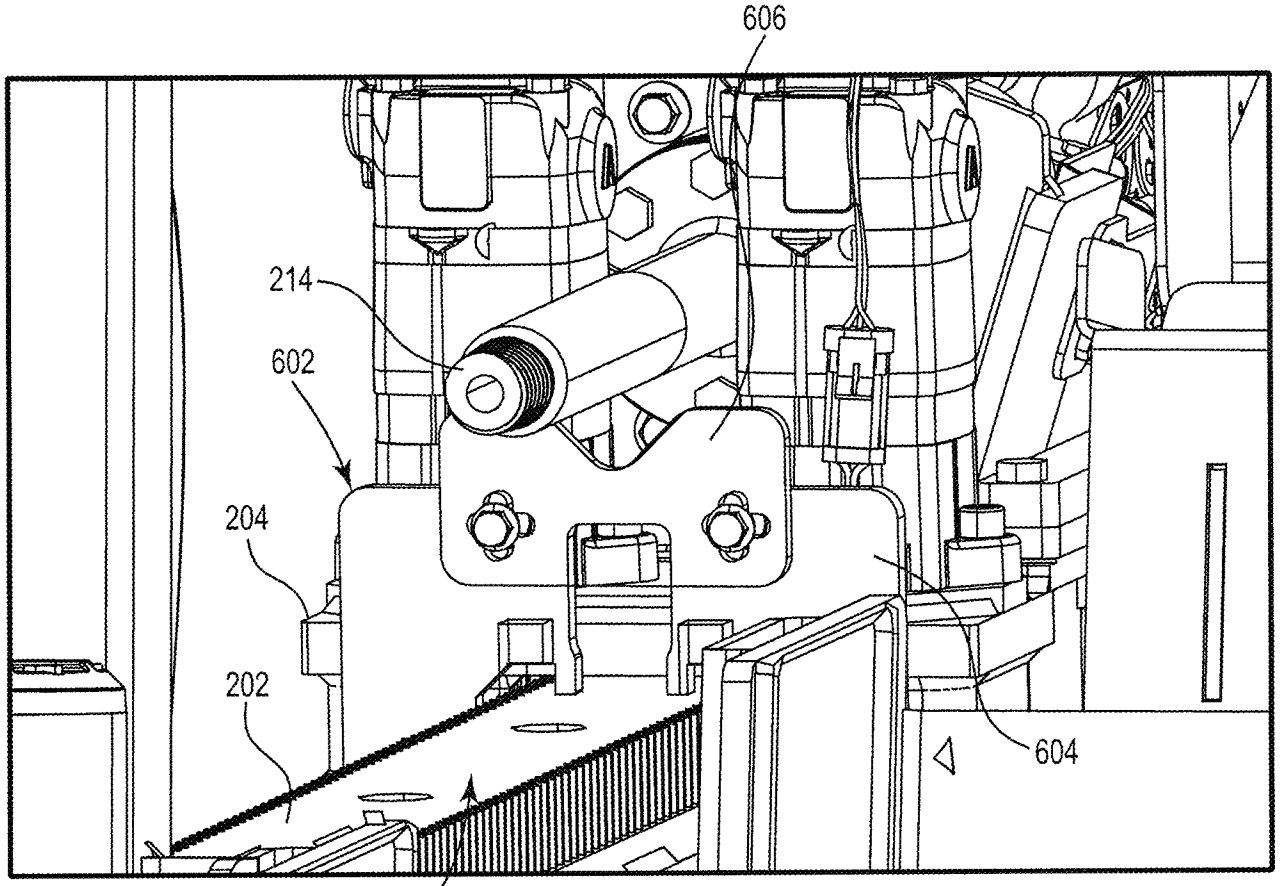
FIG. 13 is an enlarged view of a portion of a connection area of a drill illustrating an exemplary rear rest for a drill rod.
Figure 14:
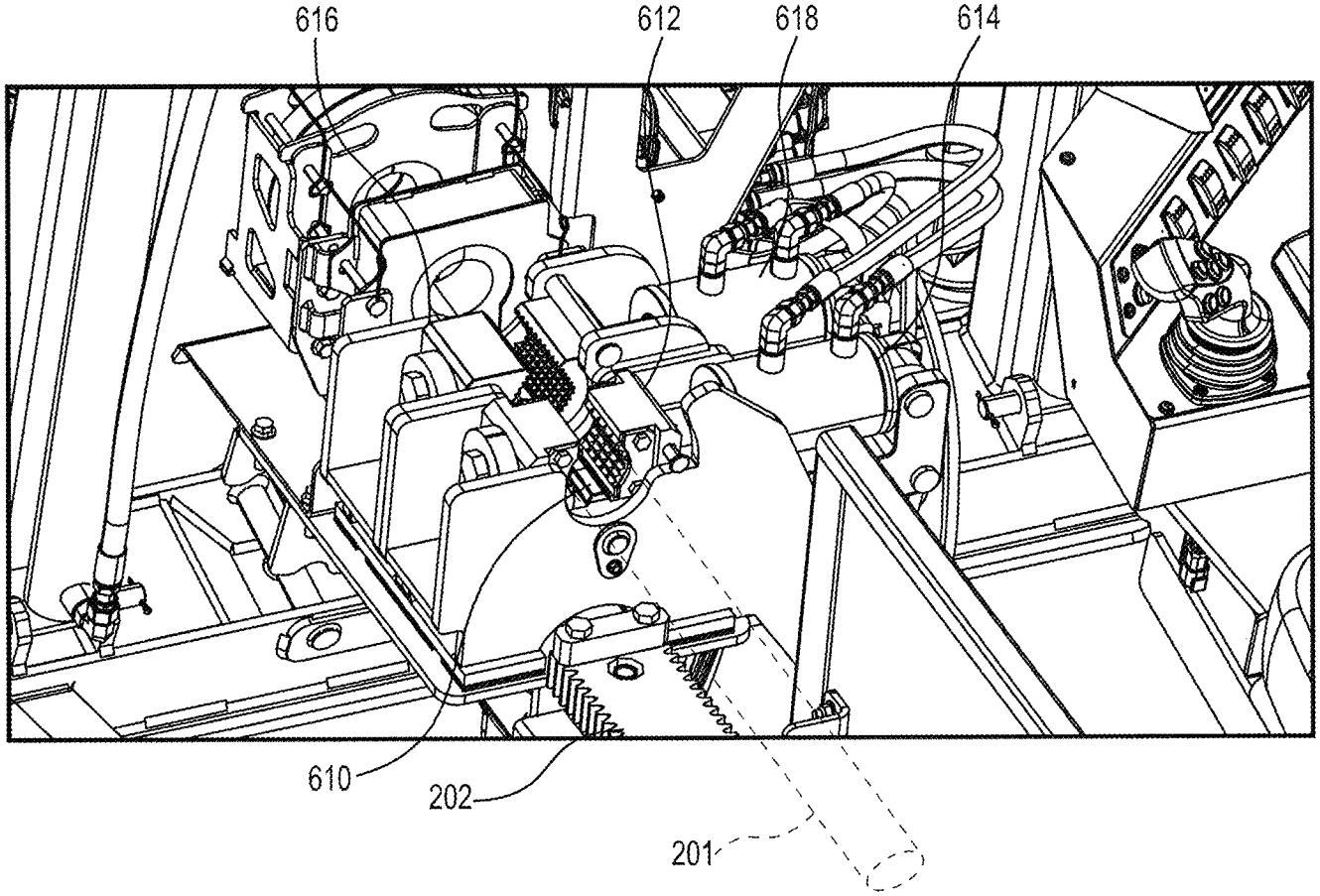
FIG. 14 is an enlarged view of another portion of a connection area of a drill illustrating a front rest for a drill rod in accordance with embodiments of the present disclosure.
Figure 15:
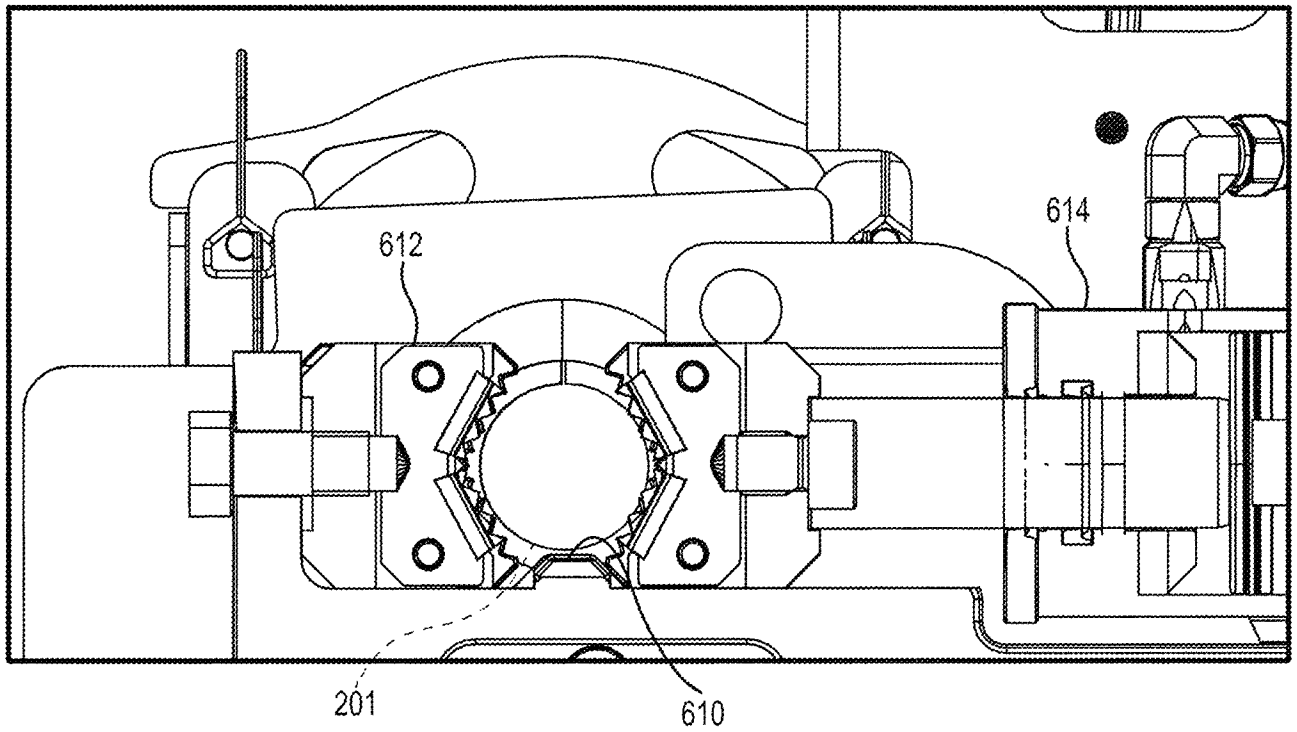
FIG. 15 is a view taken along an axis of the drill rod, again illustrating a front rest.

To assist with drill rod makeup and breakout, embodiments of the drill 100 may further include rod rests as shown in FIGS. 13-15. For example, a rear rest 602 (see FIG. 13) may be positioned proximate the drive system (e.g., carriage) and is adapted to support a rear portion of each drill rod 201 as it is connected to or disconnected from the drill string 203. In other embodiments, a front rest 610 (see FIGS. 14-15) may be positioned proximate the front end 105 of the chassis 102 and is adapted to support a forward portion of each drill rod 201 as it is being connected to, or disconnected, from, the drill string.

Larger capacity drills may include mechanical systems that assist with moving drill rod to and from the connection area. However, smaller capacity drills like drill 100 described herein may utilize smaller, lighter drill rods 201 (see FIG. 2) and thus rely on movement of the drill rods to and from the connection area 108 by manual operator lifting and positioning. Rests like those described herein may assist the operator with such manual drill rod placement in the connection area and attachment to the drill string, potentially simplifying makeup and breakout operations.

FIG. 13 illustrates the rear rest 602 in accordance with embodiments of this disclosure. The rear rest 602 may be positioned proximate the drive system and adapted to support a rear portion of each drill rod 201 as it is being connected to or disconnected from the drill string. The rear rest 602 may include a slide frame 604 having attached thereto a rod support 606. In some embodiments, the rod support is attached to the slide frame 604 with fasteners to permit some adjustment between the two components to fine-tune the height of the rod support 606 and/or to account for wear of the rod support over time.

The slide frame 604 may be configured to translate along the carriage frame 202. In some embodiments, the slide frame 604 may be attached to the carriage 204 such that it moves in unison therewith. In other embodiments, the slide frame 604 may be a separate component that can be positioned independent of the carriage 204, yet may be displaced by the carriage when the latter is advanced.

FIGS. 14 and 15 illustrate the exemplary front rest 610, which may be used with or without the rear rest 602. In some embodiments, the front rest 610 may be a standoff associated with a wrench 612 operated by an actuator, e.g., hydraulic cylinder 614. The wrench 612, along with a vise 616 (which may also be operated by a hydraulic cylinder 618), is utilized to hold drill rod 102 during makeup and breakout.

During makeup, the operator may command the carriage 204 to move rearwardly in preparation for adding a new drill rod to the drill string. Once the carriage is positioned, the operator may manually slide the rear rest 602 to a location proximate the carriage 204 (this step being unnecessary when the rear rest is physically attached to the carriage).

With the wrench 612 in an open position, the operator, optionally from a position in or near the operator station 700 (see FIG. 1), may reach into the rod box 220 and manually lift a drill rod 201 and place it on the rear rest 602 and on the front rest 610. The rests 602, 610 may be configured to orient the drill rod 201 at a position coaxial or near coaxial with the drill string 203 and spindle 214. As a result, the operator may not need to manually support the drill rod during makeup. The rests 602, 610 may similarly permit the operator to perform breakout operation without the need to manually support the drill rod as it separates from the drill string/spindle.

While shown as a standoff associated with the wrench 612, the front rest may be configured in most any manner. For example, the rest could be part of the wrench, or could be a removable component that attaches to or somewhere proximate the wrench. In other embodiments, the front rest could be V-shaped like the rear rest 606 and, in fact, could be generally identical to the rear rest without departing from the scope of this disclosure.

Illustrative embodiments are described and reference has been made to possible variations of the same. These and other variations, combinations, and modifications will be apparent to those skilled in the art, and it should be understood that the claims are not limited to the illustrative embodiments set forth herein.

What is claimed is:

1. A horizontal directional drill comprising:

a chassis defining a front end and a rear end and a longitudinal axis extending between the front and rear ends;

drive members adapted to propel the chassis over a ground surface;

a drill drive system attached to the chassis and adapted to rotate and axially advance a drill string comprised of two or more drill rods connected to one another;

a front anchor located proximate the front end of the chassis, the front anchor comprising a ground-engaging foot extending transversely to the longitudinal axis, wherein the foot is adapted to pivot about a pivot axis located at or near a transverse center of the foot; and a rear stabilizer located proximate the rear end of the chassis, the rear stabilizer comprising:

an arm extending rearwardly from the chassis;

a ground-engaging stabilizing foot pivotally attached to the arm via an arm pivot, the stabilizing foot defining a foot axis, and wherein the stabilizing foot and the foot axis extend transversely to the longitudinal axis, and wherein the stabilizing foot is movable between a transport position and a ground-engaging position; and an actuator attached to directly the stabilizing foot and directly to the arm, the actuator adapted to change an angular orientation of the stabilizing foot and the foot axis, about the arm pivot, relative to the longitudinal axis of the chassis.

2. The drill according to claim 1, wherein the arm is adapted to pivot relative to the chassis to move the stabilizing foot between the transport position and the ground-engaging position.

3. The drill according to claim 1, further comprising:

a connection area where a drill rod is positioned when being connected to or disconnected from the drill string; and a front rest positioned proximate the front end of the chassis and adapted to support a forward portion of the drill rod as it is being connected to or disconnected from the drill string.

4. The drill according to claim 3, further comprising a rear rest positioned proximate the drill drive system and adapted to support a rear portion of the drill rod as it is being connected to or disconnected from the drill string.

5. The drill according to claim 1, wherein the pivot axis extends between the front and rear ends of the chassis.

6. The drill according to claim 5, wherein the ground-engaging foot is adapted to pivot about a secondary pivot axis orthogonal to the pivot axis.

7. The drill according to claim 1, further comprising screws adapted to secure the ground-engaging foot to the ground surface.

8. The drill according to claim 1, wherein a length of the arm is adjustable.

9. The drill according to claim 1, wherein a length of the stabilizing foot is adjustable.

10. A horizontal directional drill comprising:

a chassis defining a front end and a rear end and a longitudinal axis extending between the front and rear ends;

drive members adapted to propel the chassis over a ground surface;

a drill drive system attached to the chassis and adapted to rotate and axially advance a drill string comprised of two or more drill rods connected to one another;

a front anchor located proximate the front end of the chassis; and a rear stabilizer located proximate the rear end of the chassis, the rear stabilizer comprising:

an arm extending rearwardly from the chassis;

a ground-engaging stabilizing foot pivotally attached to the arm via an arm pivot, the stabilizing foot defining a foot axis, wherein the stabilizing foot and the foot axis extend transversely to the arm, and wherein the stabilizing foot is movable between a transport position and a ground-engaging position; and an actuator attached directly to the stabilizing foot and directly to the arm, the actuator adapted to change an angular orientation of the stabilizing foot and the foot axis, about the arm pivot, relative to the arm.

11. The drill according to claim 10, wherein the arm is adapted to pivot relative to the chassis to move the stabilizing foot between the transport position and the ground-engaging position.

12. The drill according to claim 10, wherein a length of the arm is adjustable.

13. The drill according to claim 10, wherein a length of the stabilizing foot is adjustable.

* * * * *